US005700192A

United States Patent [19]

Rump

[11] Patent Number: 5,700,192

[45] Date of Patent: Dec. 23, 1997

[54] REGISTER WITH INJECTOR NOZZLE

[76] Inventor: Martin Rump, 1550 Glen Abbey Dr., Burnabyn, B. Co, Canada, V5A4C8

[21] Appl. No.: 681,955

[22] Filed: Jul. 30, 1996

[51] Int. Cl.[6] ..... F24F 11/053

[52] U.S. Cl. ..... 454/258; 454/290; 454/324; 236/49.5

[58] Field of Search ..... 236/49.5; 454/256, 454/257, 258, 284, 290, 298, 324, 334

[56] References Cited

U.S. PATENT DOCUMENTS

| | | | |
|---|---|---|---|
| 2,241,108 | 5/1941 | Akers | 236/49.5 |
| 2,537,315 | 1/1951 | Newton | 454/324 X |
| 3,645,108 | 2/1972 | Houk | 236/49.5 X |
| 3,743,180 | 7/1973 | Perkins et al. | 236/49.5 X |
| 4,537,347 | 8/1985 | Noll et al. | 236/49.5 |
| 5,304,094 | 4/1994 | MacCracken | 454/258 |

FOREIGN PATENT DOCUMENTS

| | | | |
|---|---|---|---|
| 167434 | 2/1934 | Switzerland | 454/324 |
| 1423870 | 9/1988 | U.S.S.R. | 236/49.5 |

*Primary Examiner*—Harold Joyce

[57] ABSTRACT

A register of a forced air system to include an injector and a damper switch to regulate a thermostatic element for heated and air-conditioned airstreams. A direct drive mechanism to allow the thermostatic element to control the movement of a sliding grill.

1 Claim, 5 Drawing Sheets

REGISTER WITH INJECTOR NOZZLE

BACKGROUND OF THE INVENTION

This invention relates to floor registers for forced air systems. U.S. Pat. No. 5,472,380 to Sarazen describes a floor register with a filter. The purpose of that invention is to integrate an installation of a detachable filter element with easy access. That invention relates to a register controlled by a manually operated sliding grill disposed beneath the top grille. The sliding grill is configured with widthwise vanes and lengthwise ribs that are complementary to the vanes and ribs of the top grille. When designing a self regulating register for air systems much attention is given to the closing and opening mechanisms. The sliding grill has the advantage of being an effective short stroke opening and closing device, since the thermostatic element which is used in this self regulated register produces only relative small strokes.

SUMMARY OF THE INVENTION

The present invention solves the problem existing with a self regulated floor register operated by a thermostatic element. The air which represents the room temperature is normally not able to reach the thermostatic element inside a floor-register assembly. This invention incorporates an injector nozzle, which sucks in air from a room which represents the room temperature to allow the thermostatic element to be effectively exposed to the temperature of the surrounding room. The opening and closing position of the sliding grill does not influence the function of the injector nozzle in this invention. The other aspect of this invention is to allow the self regulated floor register to work as well on heated pressurized air and/or on pressurized air conditioned air. A damper switch redirects pressurized cool air conditioned air into the direction of the thermostatic element and lowering the temperature around the thermostatic element; pretending a "cold" room temperature and forcing the floor register to stay open. If the damper switch is left in a position somehow halfway between "heating-only" and "air condition-only" the air surrounding the thermostatic element will get a mixture out of room air and forced air condition air, allowing the floor register to reduce the pressurized air condition output. The field of art to which the invention applies is also related to the mechanical drive to allow a thermostatic element with a relative small out-put stroke to drive a lever arm assembly giving a sliding grill enough movement to open and close a floor register within the normal room temperature range.

BRIEF DESCRIPTION OF THE DRAWINGS

FIG. 6 is a top view of the floor register.

DESCRIPTION OF THE PREFERRED EMBODIMENT

Figure 1:
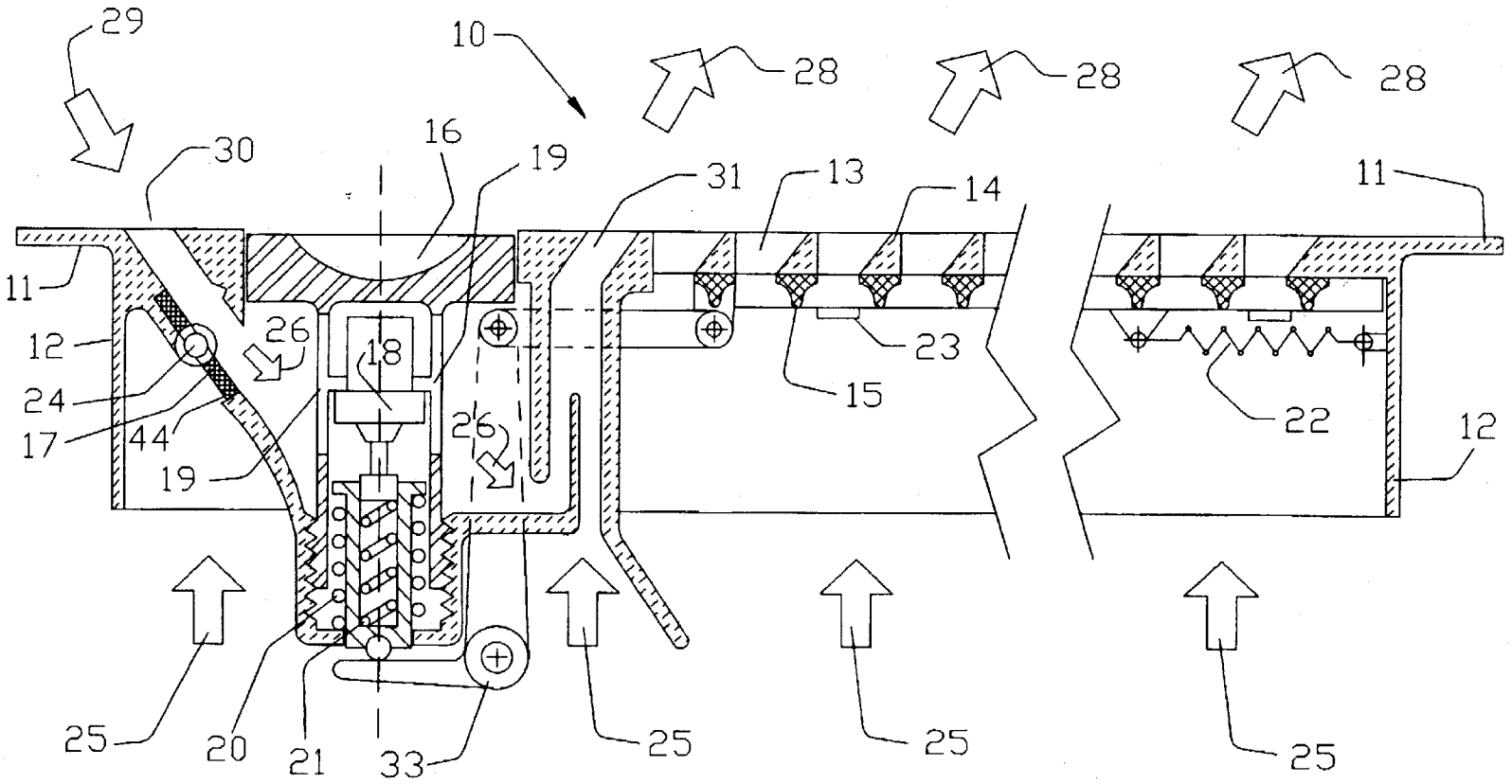
FIG. 1 is a cross sectional view of the register taken along line 9—9 in FIG. 6.
Figure 3:
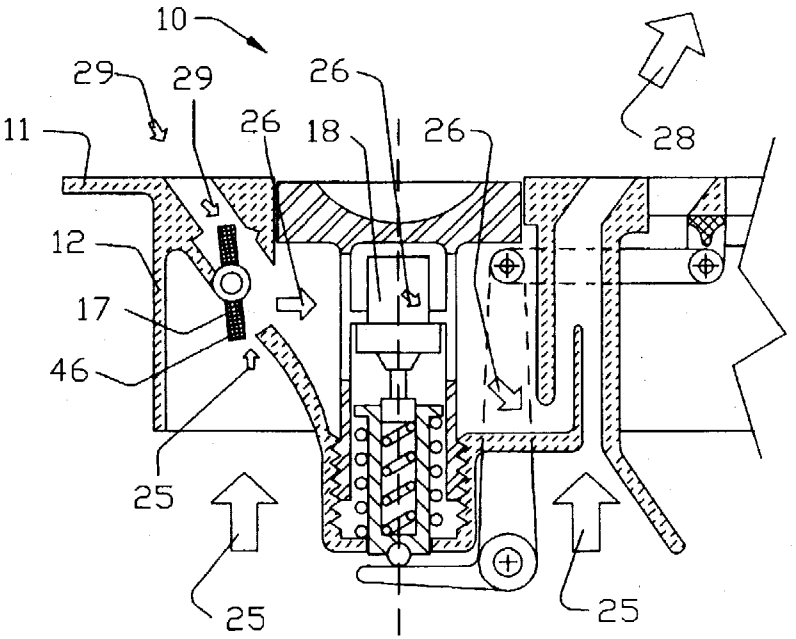
FIG. 3 is a cross sectional view of the register for the damper switch in a half open position
Figure 2:
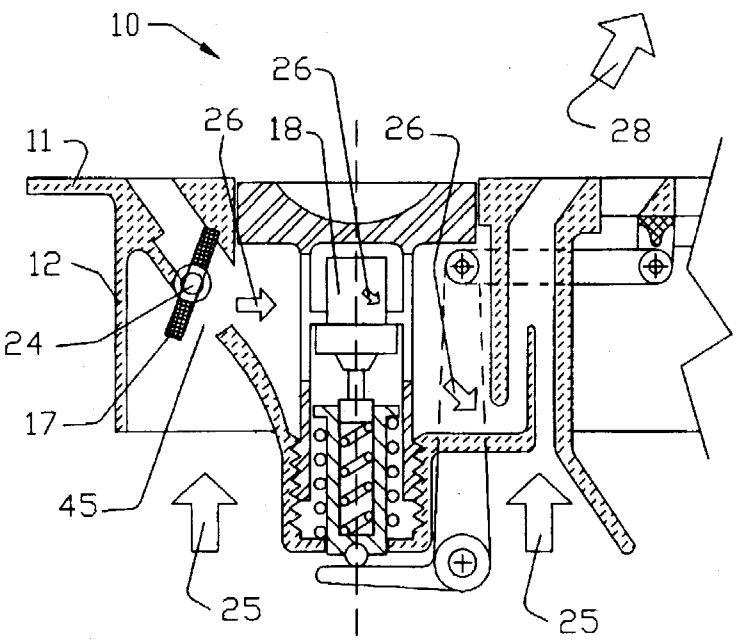
FIG. 2 is a cross sectional view of the register for the damper switch in an air condition position
Figure 4B:
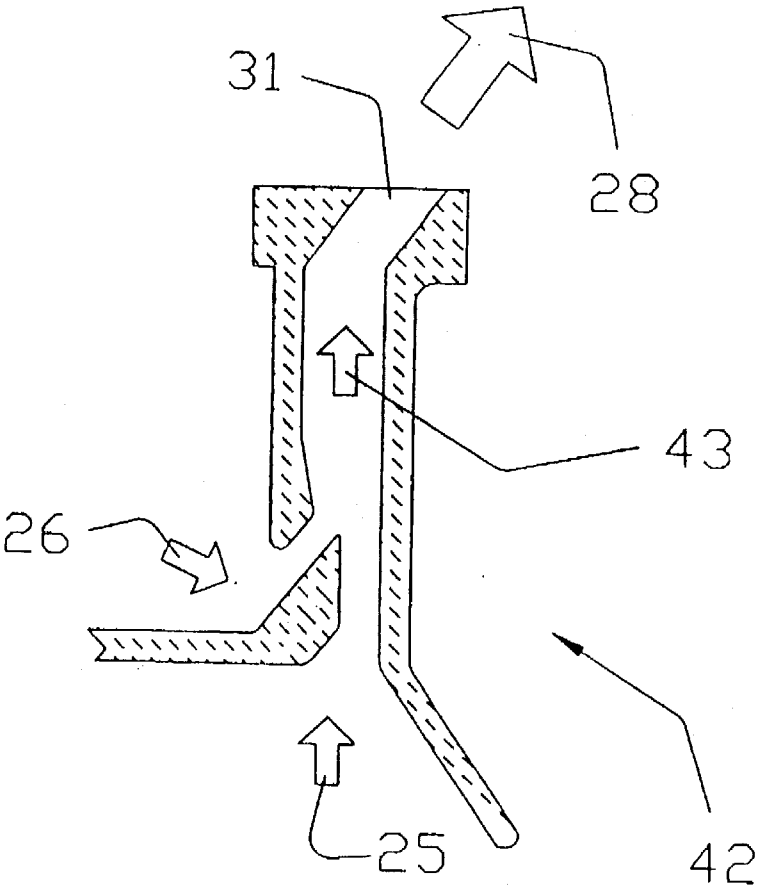
FIG. 4*a* and 4*b* are cross sectional view of two different injector nozzles.
Figure 4A:
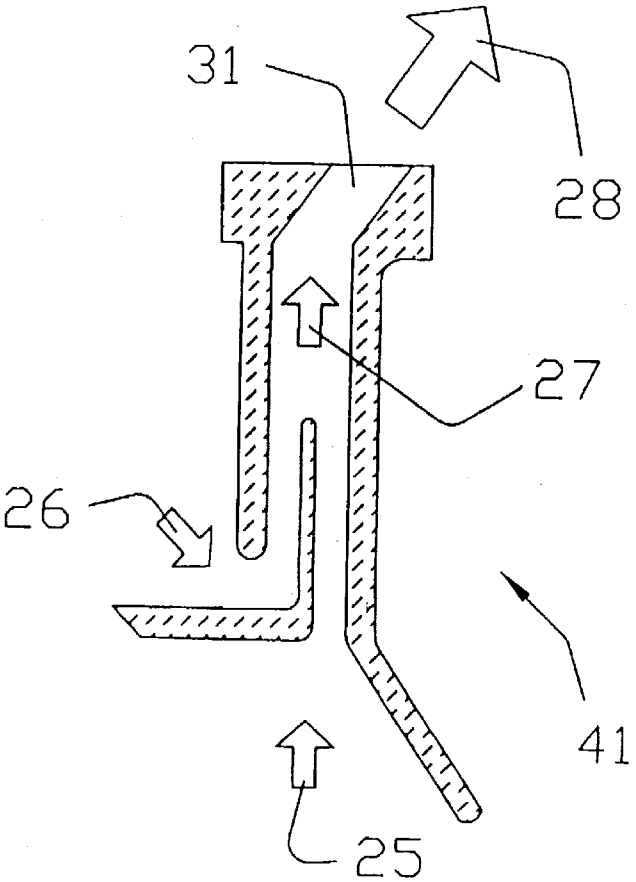
Figure 4B:
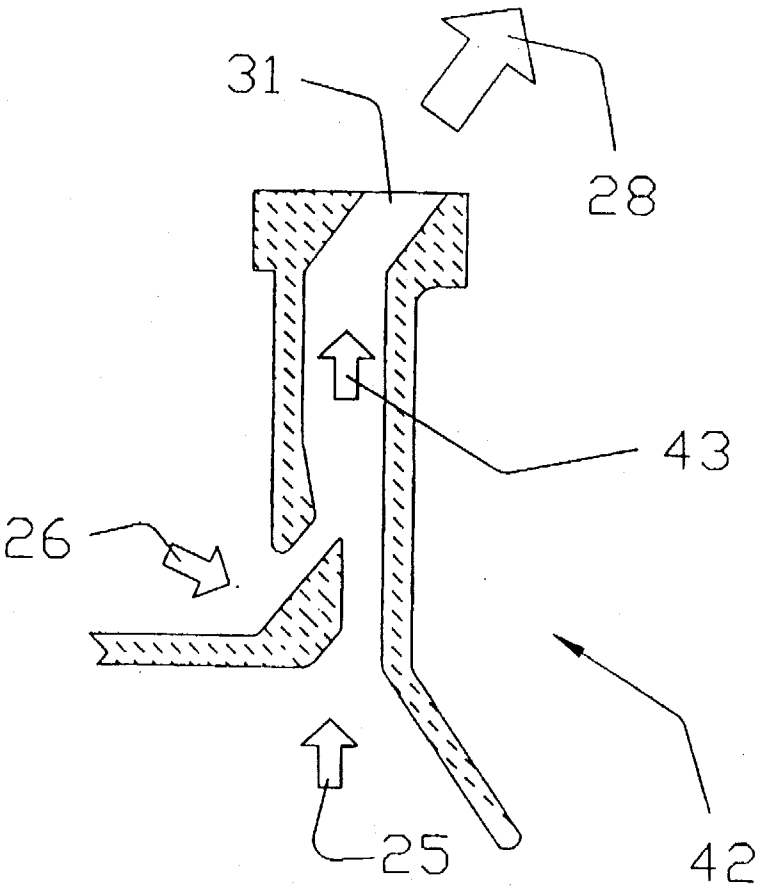
Figure 4A:
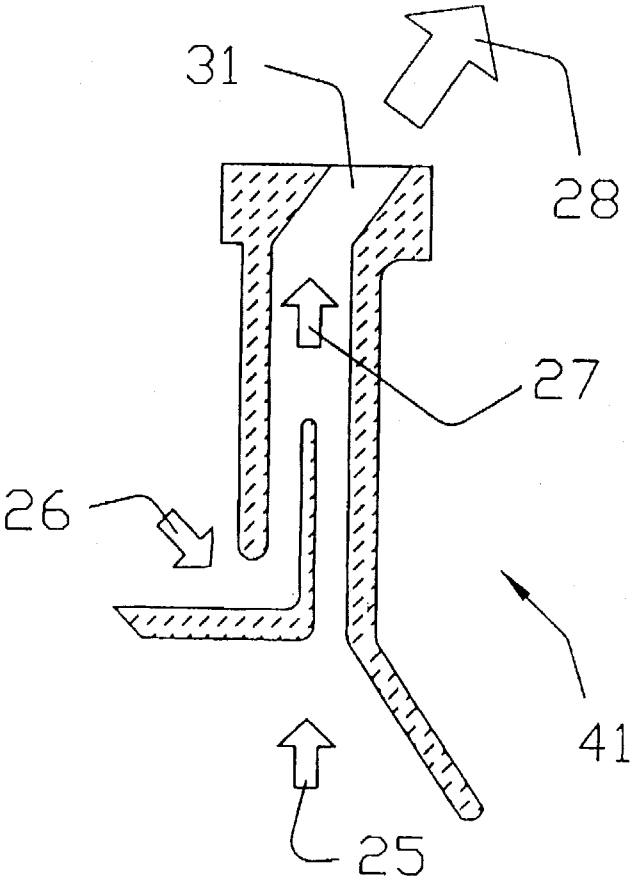
Figure 5:
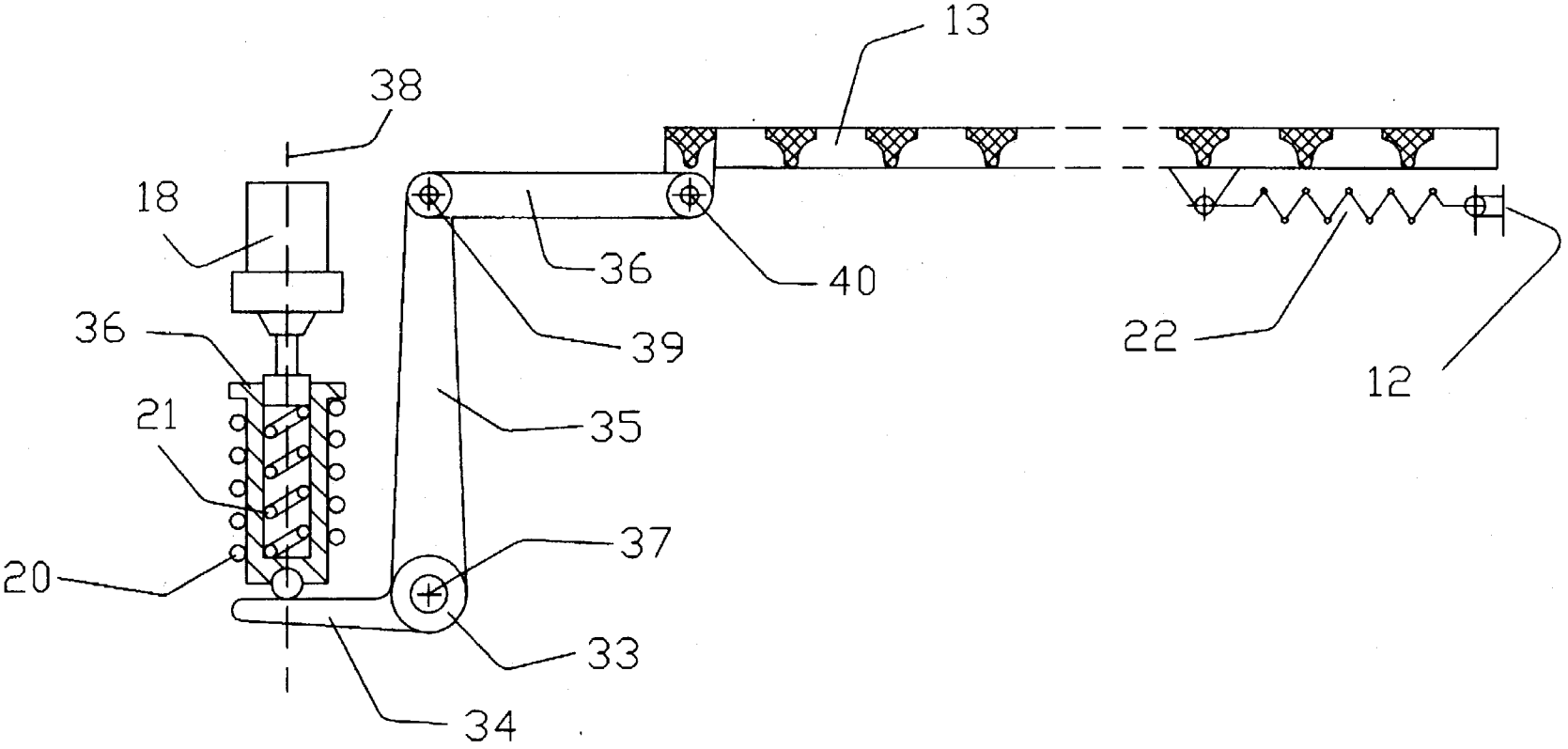
FIG. 5 is a plan view of the driving mechanism for the thermostatic element movement.

Referring to FIG. 1 there is shown a cross-sectional view of a register 10 with a frame 12, and an outer flange 11 where pressurized air 25 either heated or cooled by an air conditioner passing through an assembly of a slide grille 15 and a grill 13 with a rib 14. The discharge air 28 is mixing with room air 29 above register 10. A dial knob 16 has in its lower part vent holes 19 to carry a thermostatic element 18 which pushes on to a compression spring 20. If the thermostatic element 18 expands over its limit an override spring 21 is protecting the thermostatic element from internal damage. To ensure that a lever assembly 33 is touching the plunger 36 in FIG. 5, a return spring 22 is pulling the slide grille 15 between the ridge 23 and the rib 14 against the frame 12. A damper in closed position 44 is allowing the room air 29 to pass through an intake opening 30 to reach a suction air chamber 26 where the thermostatic element 18 is located. As shown in FIG. 2, the damper in open position 45 is allowing pressurized air 25 in this case cool air conditioned air to reach suction chamber 26. The damper switch 17 is rotating around an axle 24 which is part of the frame 12 with the outer flange 11. After the air leaves the suction chamber 26 it mixes with pressurized air 25 and is discharged at discharge air 28 on the upper side of flange 11. FIG. 3 shows the damper switch 17 in the regulating position 46. Suction chamber 26 is feeding from pressurized air 25 which is cool air conditioned air and warmer room air 29 at the same time to allow thermostatic element 18 to cool below room air 29 and forces the slide grill 15 in FIG. 1 to open. The damper switch 17 in open position 45 in FIG. 2 allows only cooled pressurized air 25 to reach the suction chamber 26 so that the thermostatic element 18 is exposed to an air temperature different from room air 29. As shown in FIG. 4*a* and 4*b*, two different types of injector nozzles 41 and 42 are part of register 10 in FIG. 1–3 define the cross sectional shape of the injector 27 and 43 along arrows 9—9 in FIG. 6. In FIG. 4*a*, the injector nozzle 41 discharges suction air 26 in a parallel stream together with the pressurized air 25 into the injector 27 and then discharges the air into the discharged opening 31. In FIG. 4*b*, the injector nozzle 42 discharges suction air 26 in an angle into the stream of pressurized air 25 at the injector 43 and together discharges the mixed air into the discharge opening 31. As shown in FIG. 5, thermostatic element 18 is pushing on a plunger 36 with axis 38 which incorporates an override spring 21 and is surrounded by a compression spring 20 which produces a powerful return force to control the movements of thermostatic element 18. The plunger 36 tilts against a short arm lever 34 of lever assembly 33 which pivots around lever pivot 37. The long arm lever 35 is also part of lever assembly 33 and is connected to link 36 in link pivot 39. Link 36 is attached in grill pivot 40 and to grill 13 with its return spring 22 which is fixed to frame 12. As shown in FIG. 6 and FIG. 1–3 register 10 has an outer flange 11 and a frame 12. As shown in FIG. 6, arrow 9—9 gives the cross-sectional view for FIG. 1–3. FIG. 6 shows the location of the temperature marker 48 around dial 16 and the damper handle 47 with the damper marker 49. As show in the FIG. 1 and 6, intake opening 30 is placed in distance to discharge opening 31 and discharge air 28.

What is claimed is:

1. A heating and cooling register for admitting forced air into the room from a forced air system, comprising:

a housing, said housing defining a top flanged having an opening disposed generally centrally therein;

a first plurality of elongated ribs extending parallel to each other across said opening and spaced apart from each other to define spaces therebetween, each rib having a bottom edge;

a second plurality of elongated ribs extending parallel to each other and spaced apart from each other to define spaces therebetween; said second elongated ribs being disposed adjacent said bottom edge of the first elongated ribs, means for sliding said second elongated fibs with respect to said first elongated ribs for opening and closing said opening;

said means for sliding including a lever assembly pivotably attached to said second elongated ribs for the movement thereof, said lever assembly being L-shaped with a long arm and a short arm, said lever assembly being pivotably attached to the housing at the junction of the L-shape, and actuating means for moving said second elongated ribs via said lever assembly, said actuating means being a thermostatic element having it plunger for engaging said short arm, said long arm being pivotably attached to said second elongated ribs; and means for alternatively supplying said forced air, room air, or forced air and room air to said thermostatic whereby the flow of air through said opening is controlled.

* * * * *